US005677100A

United States Patent [19]

Asano et al.

[11] Patent Number: 5,677,100

[45] Date of Patent: Oct. 14, 1997

[54] ENCAPSULATED TONER FOR HEAT-AND-PRESSURE FIXING

[75] Inventors: Tetsuya Asano; Tetsuhiro Semura; Katsutoshi Aoki, all of Wakayama, Japan

[73] Assignee: Kao Corporation, Tokyo, Japan

[21] Appl. No.: 569,990

[22] Filed: Dec. 8, 1995

[30] Foreign Application Priority Data

Dec. 16, 1994 [JP] Japan ..... 6-334159

[51] Int. Cl.[6] ..... G03G 9/093

[52] U.S. Cl. ..... 430/138

[58] Field of Search ..... 430/106, 126, 430/138, 137

[56] References Cited

U.S. PATENT DOCUMENTS

| | | | |
|---|---|---|---|
| 5,082,757 | 1/1992 | Keoshkerian et al. | 430/106.6 |
| 5,104,763 | 4/1992 | Ong et al. | 430/104 |

FOREIGN PATENT DOCUMENTS

| | | |
|---|---|---|
| 53-124428 | 10/1978 | Japan . |
| 58-205162 | 11/1983 | Japan . |
| 58-205163 | 11/1983 | Japan . |
| 63-128357 | 5/1988 | Japan . |
| 63-128358 | 5/1988 | Japan . |
| 63-128359 | 5/1988 | Japan . |
| 63-128360 | 5/1988 | Japan . |
| 63-128361 | 5/1988 | Japan . |
| 63-128362 | 5/1988 | Japan . |
| 63-281168 | 11/1988 | Japan . |
| 4185358 | 7/1992 | Japan . |
| 6130713 | 5/1994 | Japan . |

OTHER PUBLICATIONS

T. Kondo and N. Koishi, 1987, *Microcapsule,* 11 Pages (p. 28, lines 8–20—abridged translation).

*Primary Examiner*—John Goodrow

*Attorney, Agent, or Firm*—Birch, Stewart, Kolasch & Birch, LLP

[57] ABSTRACT

The encapsulated toner for heat-and-pressure fixing includes a heat-fusible core material containing at least a thermoplastic resin and a coloring agent and a shell formed thereon so as to cover the surface of the heat-fusible core material, a main component of the shell being a hybrid resin having a molecular structure including a molecular chain obtainable by condensation polymerization and a molecular chain obtainable by addition polymerization, the two types of the molecular chains being chemically bonded.

11 Claims, No Drawings

ENCAPSULATED TONER FOR HEAT-AND-PRESSURE FIXING

BACKGROUND OF THE INVENTION

1. Field of the Invention

The present invention relates to an encapsulated toner for heat-and-pressure fixing used for development of electrostatic latent images in an electrophotography, an electrostatic printing, or an electrostatic recording, and a method for producing the encapsulated toner.

2. Discussion of the Related Art

Conventionally, there have been proposed to various techniques for achieving low-temperature fixing by using an encapsulated toner comprising a core material and a shell so as to cover the surface of the core material as a toner.

In particular, proposed as a toner for heat-and-pressure fixing, an encapsulated toner for heat roller fixing which comprises a core material made of a resin having a low glass transition temperature which serves to enhance the fixing strength, though blocking at a high temperature may take place if used alone, and a shell of a high-melting point resin wall for the purpose of imparting blocking resistance to the toner.

However, conventional encapsulated toners have the following problems:

(a) Necessitating a higher load to production facilities because the toners are produced by a spray-drying method (see Japanese Patent Laid-Open Nos. 58-205162, 58-205163, 63-128357, 63-128358, 63-128359, 63-128360, 63-128361, and 63-128362);

(b) Having poor production stability because of the use of acid chlorides for the production (see Japanese Patent Laid-Open No. 63-281168); and (c) Having poor fixing ability because of the use of crystalline polyesters and a high Tg of the core material (Japanese Patent Laid-Open No. 4-185358).

In view of the above problems, Japanese Patent Laid-Open No. 6-130713 discloses an encapsulated toner for heat-and-pressure fixing which has excellent offset resistance, low-temperature fixing ability, and blocking resistance when the encapsulated toner is used for heat-and-pressure fixing using a heat roller, thereby making it possible to stably form clear fixed images free from background for a large number of copies.

However, although the polyester resin inherently has a good fixing ability, the triboelectric charge of the toner is likely to be increased under high-temperature, high-humidity conditions, particularly when the acid value of the polyester resin employed is not less than 5 KOH mg/g. Also, in the case where the acid value is not less than 20 KOH mg/g, positively chargeable toners cannot be easily obtained depending upon the toner compositions or types of carriers used. Further, in the case where an encapsulated structure is intended to be formed by in situ polymerization, it is necessary to previously dissolve the shell-forming resins in the polymerizable monomers used as starting materials for the core materials. However, when the polyester resins are used, those having high acid values do not sufficiently dissolve in the polymerizable monomers, thereby limiting the properties of the usable resins.

SUMMARY OF THE INVENTION

An object of the present invention is to provide an encapsulated toner which has excellent offset resistance, low-temperature fixing ability, and blocking resistance, and further has excellent stability in the triboelectric charge under high-temperature, high-humidity conditions, and is easily chargeable to negative or positive charges, when the encapsulated toner is used for heat-and pressure fixing using a heat roller.

Another object of the present invention is to provide a method for producing an encapsulated toner capable of stably forming an encapsulated structure, while selecting a wide variety of shell-forming resins having good compatibility with the core materials.

As a result of intensive research in view of the above problems, the present inventors have found that an encapsulated toner with satisfactory performance can be produced by carrying out in situ polymerization using a particular resin having a molecular structure comprising a molecular chain obtainable by condensation polymerization and a molecular chain obtainable by addition polymerization, the two types of the molecular chains being chemically bonded (hereinafter simply referred to as "hybrid resin").

Specifically, the gist of the present invention is as follows:

(1) An encapsulated toner for heat-and-pressure fixing comprising a heat-fusible core material containing at least a thermoplastic resin and a coloring agent and a shell formed thereon so as to cover the surface of the heat-fusible core material, a main component of the shell being a hybrid resin having a molecular structure comprising a molecular chain obtainable by condensation polymerization and a molecular chain obtainable by addition polymerization, the two types of the molecular chains being chemically bonded;

(2) The encapsulated toner for heat-and-pressure fixing described in (1) above, wherein the molecular chain obtainable by condensation polymerization is selected from the group consisting of polyesters, polyester-polyamides, and polyamides, and the molecular chain obtainable by addition polymerization is vinyl resins obtainable by radical polymerization;

(3) The encapsulated toner for heat-and-pressure fixing described in (1) or (2) above, wherein the hybrid resin has a glass transition temperature of from 50° to 80° C.;

(4) The encapsulated toner for heat-and-pressure fixing described in any one of (1) to (3) above, wherein the hybrid resin has an acid value of from 3 to 50 KOH mg/g;

(5) The encapsulated toner for heat-and/pressure fixing described in any one of (1) to (4) above, wherein the hybrid resin is obtainable by concurrently carrying out condensation polymerization reaction and addition polymerization reaction in one reaction vessel by using a mixture containing monomers for a condensation polymerization resin, monomers for an addition polymerization resin, and a compound capable of reacting with both monomers for a condensation polymerization resin and monomers for an addition polymerization resin;

(6) The encapsulated toner for heat-and-pressure fixing described in (5) above, wherein the weight ratio of the monomers for the condensation polymerization resin to the monomers for the addition polymerization resin is in the range of from 50/50 to 95/5;

(7) The encapsulated toner for heat-and-pressure fixing described in any one of (1) to (6) above, wherein the glass transition temperature ascribed to the thermoplastic resin used as a main component of the heat-fusible core material is from 10° to 50° C.;

(8) A method for producing an encapsulated toner for heat-and-pressure fixing comprising a heat-fusible core material containing at least a thermoplastic resin and a coloring agent and a shell formed thereon so as to cover the surface of the heat-fusible core material, comprising the step of carrying out in situ polymerization using a hybrid resin having a molecular structure comprising a molecular chain obtainable by condensation polymerization and a molecular chain obtainable by addition polymerization, the two types of the molecular chains being chemically bonded, while localizing the hybrid resin as an outermost layer of toner particles, to thereby form a shell with the hybrid resin on the surface of the heat-fusible core material;

(9) The method described in (8) above, wherein the amount of the hybrid resin is from 3 to 50 parts by weight, based on 100 parts by weight of the heat-fusible core material;

(10) The method described in (8) or (9) above, wherein the hybrid resin has an acid value of from 3 to 50 KOH mg/g;

(11) The method described in any one of (8) to (10) above, wherein the hybrid resin is obtainable by concurrently carrying out condensation polymerization reaction and addition polymerization reaction in one reaction vessel by using a mixture containing monomers for a condensation polymerization resin, monomers for an addition polymerization resin, and a compound capable of reacting with both monomers for a condensation polymerization resin and monomers for an addition polymerization resin; and

(12) The method described in (11) above, wherein the weight ratio of the monomers for the condensation polymerization resin to the monomers for the addition polymerization resin is in the range of from 50/50 to 95/5.

DETAILED DESCRIPTION OF THE INVENTION

The encapsulated toner for heat-and-pressure fixing of the present invention is characterized in that the main component of the shell is a hybrid resin having a molecular structure comprising a molecular chain obtainable by condensation polymerization and a molecular chain obtainable by addition polymerization, the two types of the molecular chains being chemically bonded. First, the hybrid resin mentioned above will be detailed below.

Here, the hybrid resin in the present invention has one of the following structures:

(1) A resin having a molecular structure comprising a vinyl polymer chain having one or more carboxyl groups, hydroxyl groups or amino groups in a molecule and/or at a terminal; and a condensation polymerization polymer chain, both of the polymer chains being bonded together by condensation reaction;

(2) A resin having a molecular structure comprising a condensation polymerization polymer chain having one or more unsaturated bonds in a molecule and/or at a terminal; and a vinyl polymer chain, both of the polymer chains being bonded together by addition reaction; or (3) A resin having a molecular structure comprising molecular structures described in both (1) and (2).

Incidentally, the above hybrid resins having the above molecular structures may be used singly or in a combination.

The hybrid resin in the present invention is obtainable by, for instance, concurrently carrying out condensation polymerization reaction and addition polymerization reaction in one reaction vessel by using a mixture containing monomers for a condensation polymerization resin, monomers for an addition polymerization resin, and a compound capable of reacting with both monomers for a condensation polymerization resin and monomers for an addition polymerization resin.

In the present invention, a hybrid resin comprising a molecular chain obtainable by condensation polymerization consisting of polyesters, polyester-polyamides, or polyamides, and a molecular chain obtainable by addition polymerization consisting of vinyl resins obtainable by radical polymerization is preferably used. Therefore, the monomers for a condensation polymerization resin or the monomers for an addition polymerization resin are not particularly limited, as long as polyesters, polyester-polyamides, polyamides, or the like are obtainable by condensation polymerization, or vinyl resins, or the like are obtainable by addition polymerization.

The monomers for polyesters include dihydric alcohols or trihydric or polyhydric alcohols; dicarboxylic acids or tricarboxylic or polycarboxylic acids, or acid anhydrides thereof or lower alkyl esters thereof.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, hydrogenated bisphenol A and other dihydric alcohols.

Among the dihydric alcohol components, a preference is given to bisphenol A alkylene oxide adducts, ethylene glycol, 1,2-propylene glycol, 1,3-propylene glycol, and neopentyl glycol.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols.

Among the trihydric or higher polyhydric alcohol components, a preference is given to glycerol and trimethylolpropane.

In the present invention, these dihydric alcohol components and trihydric or higher polyhydric alcohol components may be used singly or in combination.

In addition, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and acid anhydrides thereof, lower alkyl esters thereof and other dicarboxylicacids.

Among the dicarboxylic acid components, a preference is given to maleic acid, fumaric acid, terephthalic acid, and alkenylsuccinic acids, such as n-dodecenylsuccinic acid, isodecenylsuccinic acid, n-octenylsuccinic acid, and isooctenylsuccinic acid.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)

methane, 1,2,7,8-octanetetracarboxylic acid, pyromellitic acid, Empol trimer acid, and acid anhydrides thereof, lower alkyl esters thereof and other tricarboxylic or higher polycarboxylic acids. Among the tricarboxylic or higher polycarboxylic acid components, a preference is given to trimellitic acid and derivatives thereof because they are inexpensive and have easy reaction control.

In the present invention, these dicarboxylic acid components and tricarboxylic or higher polycarboxylic acid components may be used singly or in combination.

As for the monomers for the polyester-polyamides or the polyamides, the monomers for forming amide components are necessary. Examples of the monomers for forming amide components include polyamines, such as ethylenediamine, pentamethylenediamine, hexamethylenediamine, diethylenetriamine, iminobispropylamine, phenylenediamine, xylylenediamine, and triethylenetetramine; amino carboxylic acids, such as 6-aminocaproic acid and ε-caprolactam; and amino alcohols, such as propanolamine. Among these monomers for forming the amide components, a preference is given to hexamethylenediamine and ε-caprolactam.

Examples of the monomers used for forming the addition polymerization resins in the present invention include styrene and styrene derivatives, such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins, such as ethylene, propylene, butylene, and isobutylene; vinyl chloride, vinyl bromide, vinyl fluoride; vinyl esters, such as vinyl acetate, vinyl propionate, vinyl formate, and vinyl caproate; ethylenic monocarboxylic acids and esters thereof, such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; vinyl ethers, such as vinyl methyl ether; vinylidene halides, such as vinylidene chloride; and N-vinyl compounds, such as N-vinylpyrrole and N-vinylpyrrolidone.

Among the monomers used for forming the addition polymerization resins, a preference is given to styrene, α-methylstyrene, propylene, methyl acrylate, butyl acrylate, 2-ethylhexyl acrylate, stearyl acrylate, methyl methacrylate, butyl methacrylate, and 2-hydroxyethyl methacrylate.

Also, in the polymerization of the monomers for addition polymerization resins, polymerization initiators may be used. Examples of the polymerization initiators include azo and diazo polymerization initiators, such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators, such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer, or controlling the reaction time, two or more polymerization initiators may be used in combination.

The amount of the polymerization initiator used is from 0.1 to 20 parts by weight, preferably from 1 to 10 parts by weight, based on 100 parts by weight of the monomers for forming an addition polymerization resin.

In the polymerization of the monomers for addition polymerization resins, a crosslinking agent may be added, if necessary, to the monomer composition. In such a case, any known crosslinking agents may be suitably used. Examples of the crosslinking agents added include any of the generally known crosslinking agents, such as divinylbenzene, divinylnaphthalene, polyethylene glycol dimethacrylate, polyethylene glycol diacrylate, diethylene glycol dimethacrylate, diethylene glycol diacrylate, triethylene glycol dimethacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl) propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in combination of two or more.

The amount of these crosslinking agents used is preferably 0.001 to 15% by weight, more preferably 0.1 to 10% by weight, based on the monomers for addition polymerization resins. When the amount of these crosslinking agents used is more than 15% by weight, drastic gelation is likely to take place, thereby making it difficult to manage good reaction control. In addition, the polymerizable monomers constituting the core material are less likely to be dissolved, thereby making it impossible to carry out in situ polymerization.

In the present invention, for the purpose of obtaining a resin comprising a condensation polymerization resin and an addition polymerization resin, the two resins being chemically bonded together, polymerization is carried out by using a compound which is capable of reacting with both the monomers of the condensation polymerization resin and the monomers of the addition polymerization resin (hereinafter simply referred to as "a compound capable of reacting with both monomers").

Examples of the compounds capable of reacting with both monomers include some of the monomers for condensation polymerization resins and those for addition polymerization resins mentioned above, such as fumaric acid, acrylic acid, methacrylic acid, citraconic acid, maleic acid, and dimethyl maleate. Besides them, unsaturated alcohols having one or more hydroxyl groups also usable for addition polymerization, including 4-hydroxystyrene, 2-(4-hydroxyphenyl)propylene, 4-(3-propenyl)benzyl alcohol, 3-hydroxycyclohexene, 2-hydroxyethyl acrylate, and 2-hydroxyethyl methacrylate; and unsaturated amines having one or more amine groups also usable for addition polymerization, including 4-aminostyrene, 4-(2-propenyl) aniline, 4-(3-propenyl)benzylamine, 3-aminoxycyclohexene, 2-aminoethyl acrylate, 2-aminoethyl methacrylate, and N-methyl-4-vinylaniline may also be used. Among them, a preference is given to fumaric acid, acrylic acid, methacrylic acid, 4-hydroxystyrene, 2-hydroxyethyl acrylate, 2-hydroxyethyl methacrylate, 4-aminostyrene, 2-aminoethyl acrylate, and 2-aminoethyl methacrylate.

The amount of the compound capable of reacting with both monomers is from 0.1 to 20% by weight, preferably from 0.5 to 10% by weight, in the entire monomers.

The hybrid resins are produced by concurrently carrying out condensation polymerization reaction and addition polymerization reaction in one reaction vessel using the above-described components as starting materials. In the concurrent polymerization reactions mentioned above, both of the polymerization reactions do not have to proceed or terminate at the same time, and the reaction temperature and time can be suitably selected so as to proceed or terminate each reaction by taking into consideration each of the reaction mechanisms.

The polymerization reaction is, for example, carried out by the method comprising the steps of adding dropwise a mixture comprising monomers of an addition polymerization resin, a crosslinking agent, and a polymerization initiator to a monomer mixture for polyesters, polyester-polyamides, or polyamides, under temperature conditions appropriate for the addition polymerization reaction in the presence of the compounds capable of reacting with both monomers, the condensation polymerization being partly carried out concurrently with the addition polymerization reaction; keeping the temperature of the obtained mixture under the above temperature conditions to complete only the addition polymerization reaction; and then raising the reaction temperature to increase degree of the condensation polymerization.

Here, although the temperature conditions appropriate for the addition polymerization reaction may vary depending upon the kinds of the polymerization initiators used, they are normally in the range of from 50° to 180° C., and the optimum temperature range for increasing degree of the condensation polymerization is normally from 190° to 270° C.

By using a method where two independent polymerization reactions are concurrently carried out in one vessel, a hybrid resin can be obtained, the hybrid resin comprising the condensation polymerization resin and the addition polymerization resin, the both resins being are chemically bonded together.

In the present invention, in the case where both of the polymerization reactions are concurrently carried out, the weight ratio of the condensation polymerization resins to the addition polymerization resins or the weight ratio of the monomers for the condensation polymerization resins to the monomers for the addition polymerization resins is preferably in the range of from 50/50 to 95/5, more preferably from 70/30 to 90/10. When the proportion of the addition polymerization resin exceeds 50/50, the hybrid resin used as the shell-forming material is less likely to be formed on the core material during in situ polymerization, thereby making it likely to have poor storage stability in the resulting toner, and when the proportion of the addition polymerization resin is less than 95/5, only the properties inherent to the addition polymerization resin are notable, thereby making it difficult to achieve the effects of the present invention.

Further, the hybrid resin used in the present invention preferably has a glass transition temperature of from 50° to 80° C. When the glass transition temperature of the hybrid resin is less than 50° C., the storage stability of the resulting toner is likely to be poor, and when the glass transition temperature exceeds 80° C., the fixing ability of the resulting toner is likely to be poor. In the present invention, the glass transition temperature (Tg) refers to the temperature of an intersection of the extension of the baseline of not more than the glass transition temperature and the tangential line showing the maximum inclination between the kickoff of the peak and the top thereof as determined with a sample using a differential scanning calorimeter ("DSC MODEL 210," manufactured by Seiko Instruments, Inc.), at a heating rate of 10° C./min.

In addition, the acid value of the above hybrid resin is preferably from 8 to 50 KOH mg/g, more preferably from 10 to 30 KOH mg/g. When the acid value is less than 3 KOH mg/g, the hybrid resin used as the shell-forming material is less likely to be formed on the core material during in situ polymerization, thereby making the storage stability of the resulting toner poor, and when the hybrid resin exceeds 50 KOH mg/g, the hybrid resin is likely to shift to a water phase, thereby making the production stability poor. Here, the acid value is measured according to JIS K0070.

In the present invention, by using the hybrid resin mentioned above as the main component of the shell, an encapsulated toner having excellent stability in the triboelectric charge under high-temperature, high-humidity conditions, and easily chargeable to both positive and negative charges can be obtained. Also, an encapsulated structure can be stably formed while selecting sell-forming resins having good compatibilities with the core material in in situ polymerization method.

In the present invention, the hybrid resin is used as the main component of the shell resin, and other resins, such as polyamide resins, polyester resins, polyesteramide resins, polyester-polyamide resins, and polyurea resins, may be added as the shell-forming materials in an amount of 0 to 50% by weight of the entire shell resin.

In the present invention, the resins used as the main component of the heat-fusible core material in the encapsulated toner include the thermoplastic resins, such as polyester-polyamide resins, polyamide resins, and vinyl resins, with a preference given to the vinyl resins.

The glass transition temperatures ascribed to the thermoplastic resin used as the main component of the heat-fusible core material described above are preferably 10° C. to 50° C., more preferably 20° C. to 40° C. When the glass transition temperature is less than 10° C., the storage stability of the encapsulated toner becomes poor, and when it exceeds 50° C., the fixing strength of the resulting encapsulated toner becomes undesirably poor.

The core material resin mentioned above may be produced any of conventional methods using monomers, polymerization initiators, and crosslinking agents, which may be similar ones to those exemplified in the hybrid resin mentioned above.

For instance, in the case where vinyl resins are used as the core material resins, it is preferred that styrene or styrene derivatives is used in an amount of 50 to 90% by weight to form the main structure of the resins, and that the ethylenic monocarboxylic acid or esters thereof is used in an amount of 10 to 50% by weight to adjust the thermal properties, such as the softening point of the resins, because the glass transition temperature of the core material resin can be controlled easily. For the purposes of controlling the molecular weight or molecular weight distribution of the polymer or controlling the reaction time, two or more polymerization initiators may be used in combination, as in the case of the polymerization initiators used for the production of the hybrid resin.

In the present invention, a coloring agent is contained in the core material of the encapsulated toner, and any of the conventional dyes or pigments, which have been used for coloring agents for the toners may be used.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, and Solvent Blue 35, and the mixtures thereof. The coloring agent is usually used in an amount of about 1 to 15 parts by weight based on 100 parts by weight of the resin contained in the core material.

In the present invention, a charge control agent may be further added. The negative charge control agents are not particularly limited, and examples thereof include azo dyes containing metals, such as "VARIFAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), and "AIZEN SPILON BLACK TRH" (manufactured by Hodogaya Chemical Co., Ltd.); copper phthalocyanine dye; metal complexes of alkyl derivatives of salicylic acid, such as "BONTRON E-81" (manufactured by Orient Chemical Co., Ltd.), "BONTRON E-82" (manufactured by Orient Chemical Co., Ltd.), and "BONTRON E-85" (manufactured by Orient Chemical Co., Ltd.); quaternary ammonium salts, such as "COPY CHARGE NX VP434" (manufactured by Hoechst); and nitroimidazole derivatives.

The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins, such as "AFP-B" (manufactured by Orient Chemical Co., Ltd.); and imidazole derivatives.

The above charge control agents may be contained in the core material in an amount of 0.1 to 8.0% by weight, preferably 0.2 to 5.0% by weight.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnishes, aliphatic fluorocarbons, and silicone oils.

Examples of the above polyolefins include resins, such as polypropylene, polyethylene, and polybutene, which have softening points of 80° to 160° C.

Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof.

Examples of the above fatty acid esters include ethyl maleate, butyl maleate, methyl stearate, butyl stearate, cetyl palmirate, and ethylene glycol montanate. Examples of the above partially saponified fatty acid esters include montanic acid esters partially saponified with calcium.

Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, and selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons.

Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide, and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish, and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference to polypropylene and polyethylene. It is preferable to use the offset inhibitors in a proportion of 1 to 20% by weight, based on the resin contained in the core material.

The encapsulated toner of the present invention is preferably produced by in situ polymerization method from the viewpoint of simplicity in the production facilities and the production steps. The method for producing the encapsulated toner of the present invention will be explained in detail below by taking in situ polymerization as an example therefor.

In the method for producing an encapsulated toner for heat-and-pressure fixing of the present invention comprising a heat-fusible core material containing at least a thermoplastic resin and a shell formed thereon so as to cover the surface of the core material, the method comprises the steps of:

(a) dissolving the shell-forming resin containing the hybrid resin in a mixture comprising a core material-constituting monomer;

(b) dispersing the mixture obtained in step (a) in an aqueous dispersant, and localizing the shell-forming resin on the surface of droplets of the core-constituting material to give a polymerizable composition; and (c) polymerizing the polymerizable composition obtained in step (b) by in situ polymerization to form the core material, the shell covering the surface of the core material.

In in situ polymerization method in the present invention, the shell can be formed by utilizing the property that when a mixed solution comprising the core-constituting materials and the shell-forming material comprising the hybrid resin is dispersed in an aqueous dispersant, the shell-forming material localizes onto the surface of the liquid droplets, i.e. the shell-forming material localizes as an outermost layer of toner particles. Specifically, the separation of the core-constituting materials and the shell-forming material in the liquid droplets of the mixed solution takes place due to the difference in the solubility indices, and the polymerization proceeds in this state to form an encapsulated structure. By this method, since a shell is formed as a layer of the shell-forming material comprising the hybrid resin with a substantially uniform thickness, the resulting toner has uniform triboelectric properties. Also, since the hybrid resin has an addition polymerization resin moiety, the hybrid resin is easily dissolved in the core material resin monomers, thereby making it possible to widely select the properties of the usable resins.

Incidentally, a general method of encapsulation by in situ polymerization is carried out by supplying monomers for shell-forming resins, polymerization initiators, etc. from either one of the inner phase or outer phase of the dispersed phase and forming a shell resin by polymerization to give an encapsulated structure (see Microcapsule, T. Kondo and N. Koishi, 1987, published by Sankyo Shuppan Kabushiki Kaisha). On the other hand, in in situ polymerization in the present invention, since the core material resin is formed in the inner portion of the shell resin by polymerizing monomers for the core material resins, polymerization initiators, etc., the encapsulation mechanism in the present invention is somewhat different from that of the general encapsulation in in situ polymerization method. However, since in the method of the present invention, the monomers are supplied only from the inner phase of the dispersed phase, the present method may be a sort of in situ polymerization in a broader sense.

In the above method, a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, hydroxyapatite, colloidal silica, alumina, tricalcium phosphate, ferrous hydroxide, titanium hydroxide, and aluminum hydroxide, with a preference given to tricalcium phosphate and hydroxyapatite. These dispersion stabilizers may be used alone or in combination of two or more.

Examples of the dispersion media used for the above dispersion stabilizers include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the method for production of the present invention, the amount of the above hybrid resin is normally from 3 to 50 parts by weight, preferably from 5 to 40 parts by weight, more preferably from 8 to 30 parts by weight, based on 100 parts by weight of the core material. When the amount of the hybrid resin is less than 3 parts by weight, the shell thus formed becomes too thin, so that the resulting toner has poor storage stability, and when the amount exceeds 50 parts by weight, the dispersed domain has too high viscosity, making it difficult produce fine grains, so that the resulting toner has poor production stability.

Although the particle size of the encapsulated toner produced by the method described above is not particularly limitative, the average particle size is usually 3 to 30 μm. The shell thickness of the encapsulated toner is preferably 0.01 to 1 μm. When the shell thickness is less than 0.01 μm, the blocking resistance of the resulting toner becomes poor, and when the shell thickness exceeds 1 μm, the heat fusibility of the resulting toner becomes undesirably poor.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride, with a preference given to finely powdered silica.

The finely powdered silica is a fine powder having Si-O-Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fine powders of fluorine polymers.

Further, for the purpose of controlling the developability of the encapsulated toner, finely powdered polymers of methyl methacrylate or butyl methacrylate may be added.

Furthermore, for the purpose of toning or reducing electric resistance on the surface of the toner, a small amount of carbon black may be used. The carbon blacks may be those of conventionally known, including various kinds such as furnace black, channel black, and acetylene black.

When the encapsulated toner for heat-and-pressure fixing of the present invention contains particulate magnetic materials, it can be used alone as a developer. In contrast, when the encapsulated toner does not contain any particulate magnetic material, a non-magnetic one-component developer or a two-component developer can be prepared by mixing the toner with a carrier. Although the carrier is not particularly limitative, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle size of the carrier is 15 to 500 μm.

When the encapsulated toner for heat-and-pressure fixing of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are utilized. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

The encapsulated toner for heat-and-pressure fixing of the present invention has not only excellent offset resistance and low-temperature fixing ability, but also good stability in the triboelectric charge and image quality under high-temperature, high-humidity conditions, when the toner is used for heat-and-pressure fixing using a heat roller. By the method of the present invention, the encapsulated structure can be stably formed while widely selecting shell-forming resins having good compatibilities with core materials, thereby making it possible to easily produce positively or negatively chargeable encapsulated toners.

EXAMPLES

The present invention is hereinafter described in more detail by means of the following production examples, examples, comparative examples, and test example, without intending to limit the scope of the present invention thereto.

Production Examples 1 and 2 (Hybrid Resin A and B)

Dicumyl peroxide (hereinafter abbreviated as "DCP") used as a polymerization initiator was dissolved in a mixture comprising monomers of vinyl resins and a compound capable of reacting with both monomers, each of kinds and amounts being shown in Table 1, and the resulting solution was placed in a dropping funnel. Polyoxypropylene(2.0)-2,2-bis(4-hydroxyphenyl)propane (hereinafter abbreviated as "BPA.PO"), polyoxyethylene(2.2)-2,2-bis(4-hydroxyphenyl)propane (hereinafter abbreviated as "BPA.EO"), terephthalic acid (hereinafter abbreviated as "TPA"), and trimellitic anhydride (hereinafter abbreviated as "TMA"), in amounts shown in Table 1, were placed in a five-liter four-neck glass flask equipped with a thermometer, a stainless stirring rod, a reflux condenser, and a nitrogen inlet tube. A mixture comprising the above monomers for vinyl resins, the compound capable of reacting with both monomers, and the polymerization initiator from the above dropping funnel was added dropwise over a period of 4 hours, while stirring the mixture in the flask at 135° C. in a mantle heater under a nitrogen atmosphere. The reaction mixture was matured for another five hours while keeping the temperature of the contents at 135° C. Thereafter, the components were heated and allowed to react with one another at 220° C.

The degree of polymerization was monitored by a softening point measured according to ASTM E 28-67, and the reaction was terminated when the softening point reached 110° C.

The obtained resins are referred to as "Hybrid Resins A and B."

Production Example 3 (Resin C)

BPA.PO, BPA.EO, TPA, TMA, and dodecenylsuccinic anhydride (hereinafter abbreviated as "DSA"), the kinds and amounts being shown in Table 1, were placed in a two-liter four-neck glass flask, to which a thermometer, a stainless stirring rod, a reflux condenser, and a nitrogen inlet tube were attached, and the components were heated in a mantle heater to 220° C. and allowed to react with one another at 220° C. in a nitrogen atmosphere. The degree of polymerization was monitored by a softening point measured according to ASTM E 28-67, and the reaction was terminated when the softening point reached 110° C.

The obtained amorphous polyester resin is referred to as "Resin C."

The glass transition temperatures of each of the obtained resins were measured by a differential scanning calorimeter ("DSC Model 210," manufactured by Seiko Instruments, Inc.), and each of the values are shown together with softening points and acid values in Table 2. Incidentally, the acid value was measured by the method according to JIS K0070.

TABLE 1

| | Resin A | | Resin B | | Resin C | |
|---|---|---|---|---|---|---|
| | Weight (g) | mol | Weight (g) | mol | Weight (g) | mol |
| Styrene | 84 | 0.8 | 84 | 0.8 | — | — |
| 2-Ethylhexyl acrylate | 16 | 0.09 | — | — | — | — |
| Butyl methacrylate | — | — | 16 | 0.1 | — | — |
| Acrylic acid | 8 | 0.1 | — | — | — | — |
| Fumaric acid | — | — | 15 | 0.2 | — | — |
| DCP | 3 | 0.01 | 3 | 0.01 | — | — |
| BPA · PO | 700 | 2.0 | 350 | 1.0 | 490 | 1.4 |
| BPA · EO | — | — | 320 | 1.0 | 192 | 0.6 |
| TPA | 266 | 1.6 | 199 | 1.2 | 166 | 1.0 |
| DSA | — | — | — | — | 161 | 0.6 |
| TMA | 38 | 0.2 | 77 | 0.4 | 77 | 0.4 |

TABLE 2

| Resin | Softening Point (°C.) | Glass Transition Temperature (°C.) | Acid Value (KOH mg/g) |
|---|---|---|---|
| A | 110 | 61 | 10 |
| B | 110 | 63 | 15 |
| C | 110 | 62 | 12 |

Example 1

20.0 parts by weight of Hybrid Resin A and 3.5 parts by weight of 2,2'-azobisisobutyronitrile were added to a mixture comprising 69.0 parts by weight of styrene, 31.0 parts by weight of 2-ethylhexyl acrylate, 0.8 parts by weight of divinylbenzene, and 7.0 parts by weight of carbon black "#44" (manufactured by Mitsubishi Kasei Corporation). The obtained mixture was introduced into an attritor ("MODEL MA-01SC," manufactured by Mitsui Miike Kakoki) and dispersed at 10° C. for 5 hours, to give a polymerizable composition. Next, 240 g of the above polymerizable composition was added to 560 g of a 4% by weight aqueous colloidal solution of tricalcium phosphate which was previously prepared in a two-liter separable glass flask. The obtained mixture was emulsified and dispersed with a "T.K. HOMO MIXER, Model M" (manufactured by Tokushu Kika Kogyo) at 15° C. and a rotational speed of 12000 rpm for 5 minutes.

Next, a four-necked glass cap was set on the flask, and a reflux condenser, a thermometer, a nitrogen inlet tube, and a stainless steel stirring rod were attached thereto. The flask was placed in an electric mantle heater. Thereafter, the contents were heated to 85° C. and allowed to react with at 85° C. for 10 hours in a nitrogen atmosphere while stirring. After the reaction product was cooled, 440 ml of a 10% by weight hydrochloric acid-aqueous solution was added to dissolve the dispersion medium. The resulting product was filtered, and the obtained solid was washed with water, dried under a reduced pressure of 20 mmHg at 45° C. for 12 hours and classified with an air classifier to give an encapsulated toner with an average particle size of 8 μm, whose shell comprises Hybrid Resin A.

To 100 parts by weight of this encapsulated toner, 0.4 parts by weight of hydrophobic silica fine powder "Aerozil R-972" (manufactured by Nippon Aerozil Ltd.) were added and mixed to obtain the encapsulated toner according to the present invention.

This toner is referred to as "Toner 1." The glass transition temperature ascribed to the resin contained in the core material was 31.0° C., and the softening point of Toner 1 was 119.4° C.

Example 2

The similar procedures to those of Example 1 were carried out up to the surface treatment step except that Hybrid Resin A was replaced with Hybrid Resin B, to give an encapsulated toner with an average particle size of 8 μm, whose shell comprises Hybrid Resin B.

This toner is referred to as "Toner 2." The glass transition temperature ascribed to the resin contained in the core material was 32.3° C., and the softening point of Toner 2 was 118.9° C.

Example 3

20.0 parts by weight of Hybrid Resin A, 1.0 part by weight of "BONTRON N-07" (manufactured by Orient Chemical Co., Ltd.), and 5.0 parts by weight of 2,2'-azobisisobutyronitrile were added to a mixture comprising 70.0 parts by weight of styrene, 30.0 parts by weight of butyl acrylate, 1.0 part by weight of divinylbenzene, and 7.0 parts by weight of carbon black "#44" (manufactured by Mitsubishi Kasei Corporation). The obtained mixture was introduced into an attritor ("MODEL MA-01SC," manufactured by Mitsui Miike Kakoki) and dispersed at 10° C. for 5 hours, to give a polymerizable composition. Next, 240 g of the above polymerizable composition was added to 560 g of a 4% by weight aqueous colloidal solution of tricalcium phosphate which was previously prepared in a two-liter separable glass flask. The obtained mixture was emulsified and dispersed with a "T.K. HOMO MIXER, Model M" (manufactured by Tokushu Kika Kogyo) at 15° C. and a rotational speed of 12000 rpm for 5 minutes.

Next, a four-necked glass cap was set on the flask, and a reflux condenser, a thermometer, a nitrogen inlet tube, and a stainless steel stirring rod were attached thereto. The flask was placed in an electric mantle heater. Thereafter, the contents were heated to 85° C. and allowed to react with at 85° C. for 10 hours in a nitrogen atmosphere while stirring. After the reaction product was cooled, 440 ml of a 10% by weight hydrochloric acid-aqueous solution was added to dissolve the dispersion medium. The resulting product was filtered, and the obtained solid was washed with water, dried under a reduced pressure of 20 mmHg at 45° C. for 12 hours and classified with an air classifier to give an encapsulated toner with an average particle size of 8 μm, whose shell comprises Hybrid Resin A.

To 100 parts by weight of this encapsulated toner, 0.4 parts by weight of hydrophobic silica fine powder "Aerozil R-972" (manufactured by Nippon Aerozil Ltd.) were added and mixed to obtain the encapsulated toner according to the present invention.

This toner is referred to as "Toner 3." The Glass transition temperature ascribed to the resin contained in the core material was 36.5° C., and the softening point of Toner 3 was 126.7° C.

Comparative Example 1

The similar procedures to those of Example 1 were carried out up to the surface treatment step except that Hybrid Resin A was replaced with Hybrid Resin C, to give an encapsulated toner with an average particle size of 8 μm, whose shell comprises an amorphous polyester (Resin C).

This toner is referred to as "Comparative Toner 1." The Glass transition temperature ascribed to the resin contained in the core material was 32.4° C., and the softening point of Comparative Toner 1 was 120.6° C.

Comparative Example 2

The similar procedures to those of Example 3 were carried out up to the surface treatment step except that Hybrid Resin A was replaced with Hybrid Resin C, to give an encapsulated toner with an average particle size of 8 μm, whose shell comprises an amorphous polyester (Resin C).

This toner is referred to as "Comparative Toner 2." The glass transition temperature ascribed to the resin contained in the core material was 35.8° C., and the softening point of Comparative Toner 2 was 124.1° C.

Test Example

Each of the toners obtained in Examples and Comparative Examples was evaluated with respect to the triboelectric charge, the toner dust in machine under high-temperature, high-humidity conditions (35° C., 85% RH), the fixing ability, and the offset resistance, using a developer prepared by placing 6 parts by weight of each of the toners and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes.

As for evaluation for the triboelectric charge and the toner dust in machine, continuous copy tests were carried out under high-temperature, high-humidity conditions (35° C., 85% RH) by loading each of the developers prepared as described above on a commercially available electrophotographic copying machine to form images. Here, Toners 1 and 2 and Comparative Toner 1 were loaded on a modified copy machine of "FT4080" (manufactured by Ricoh Co., Ltd.), and Toner 3 and Comparative Toner 2 were loaded on a modified copy machine of "FT2700" (manufactured by Ricoh Co., Ltd.). The detailed evaluation method is given below in the section of triboelectric charge.

(1) Triboelectric Charge

The triboelectric charge was measured by a blow-off type electric charge measuring device as described below. Specifically, a specific charge measuring device equipped with a Faraday cage, a capacitor and an electrometer was used. First, W (g) (about 0.15 to 0.20 g) of the developer prepared above was placed into a brass measurement cell equipped with a stainless screen of 500 mesh, adjustable to any mesh size to block the passing of the carrier particles. Next, after aspirating from a suction opening for 5 seconds, blowing was carried out for 5 seconds under a pressure indicated by a barometric regulator of 0.6 kgf/cm$^2$, thereby selectively removing only the toner from the cell.

In this case, the voltage of the electrometer after 2 seconds from the start of blowing was defined as V (volt). Here, when the electric capacitance of the capacitor was defined as C (μF), the specific triboelectric charge Q/m of this toner can be calculated by the following equation:

$$Q/m\ (\mu C/g)=C\times V/m$$

Here, m was the weight of the toner contained in W (g) of the developer. When the weight of the toner in the developer was defined as T (g) and the weight of the developer as D (g), the toner concentration in a given sample can be expressed as T/D×100(%), and m can be calculated as shown in the following equation:

$$m\ (g)=W\times(T/D)$$

Incidentally, the measurements of the triboelectric charge at start and after printing 10,000 sheets were taken using each of developers at start and after making 10,000 continuous copies in the above printing test.

The results are shown in Table 3.

(2) Toner Dust in Machine

The toner dust in machine and the image quality were evaluated by visually observing the toner dust in machine while carrying out the above printing test. The results are shown in Table 3.

(3) Fixing Ability

The fixing ability was evaluated by the method as described below. Specifically, each of the developers prepared as described above was loaded on a commercially available electrophotographic copy machine to develop images. Toners 1 and 2 and Comparative Toner 1 were loaded on a modified copy machine of "FT4080" (manufactured by Ricoh Co., Ltd.), FT4800 being equipped with an amorphous selene photoconductor. Toner 3 and Comparative Toner 2 being loaded on a modified copy machine of "FT2700" (manufactured by Ricoh Co., Ltd.), FT2700 being equipped with an organic photoconductor. From each of the above copying machine, a fixing device was removed so as to form unfixed images, and fixing was carried out Using an external fixing device (linear speed: 255 mm/sec) while controlling the fixing temperature to a temperature range of from 100° C. to 200° C. The fixing ability of each of the toners was evaluated by the lowest fixing temperature determined from above.

The lowest fixing temperature used herein is the temperature of the fixing roller at which the fixing ratio of the toner exceeds 70%. This fixing ratio of the toner was determined by placing a load of 500 g on a sand-containing rubber eraser (LION No. 502) having a bottom area of 15 mm×7.5 mm which contacted the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from the density values before and after the eraser treatment using the following equation.

$$\text{Fixing ratio (\%)}=\frac{\text{Image density after eraser treatment}}{\text{Image density before eraser treatment}}\times 100$$

The results are shown in Table 4.

(4) Offset Resistance

The offset resistance was evaluated by measuring the temperature of the low-temperature offset disappearance and the temperature of the high-temperature offset initiation. Specifically, copying tests were carried out by raising the temperature of the heat roller surface in the range from 100° C. to 200° C., and at each temperature, the adhesion of the toner onto the heat roller surface for fixing was evaluated by visual observation. The results are shown in Table 4.

TABLE 3

| | Triboelectric Charge at Start (μC/g) | Triboelectric Charge after Printing 10000 Sheets (μC/g) | Image Quality |
|---|---|---|---|
| Toner 1 | −16.2 | −17.3 | Excellent until copying 10000 sheets |
| Toner 2 | −19.1 | −20.0 | Excellent until copying 10000 sheets |
| Toner 3 | +12.4 | +11.8 | Excellent until copying 10000 sheets |
| Comparative Toner 1 | −19.3 | −28.0 | Generation of Background after copying 1000 sheets |
| Comparative Toner 2 | +14.0 | +3.9 | Generation of Background after copying 500 sheets |

TABLE 4

| | Lowest Fixing Temp. (°C.) | Low-Temp. Offset Disappearing Temp. (°C.) | High-Temp. Offset Initiating Temp. (°C.) |
|---|---|---|---|
| Toner 1 | 120 | 110 | >200 |
| Toner 2 | 120 | 110 | >200 |
| Toner 3 | 125 | 120 | >200 |
| Comparative Toner 1 | 120 | 110 | >200 |
| Comparative Toner 2 | 125 | 115 | >200 |

As is clear from Tables 3 and 4, all of Toners 1 to 3 of the present invention whose shell comprises a hybrid resin had excellent stability in triboelectric charge under high-temperature, high humidity conditions and were free from toner dusts in machine, while maintaining excellent low-temperature fixing ability and offset resistance, thereby making it possible to maintain high quality fixed images for a long period of time.

By contrast, although Comparative Toners 1 and 2 whose shell comprises an amorphous polyester had excellent low-temperature fixing ability and offset resistance, long-term continuous copying under high-temperature, high-humidity conditions caused significant changes for stability in triboelectric charge, thereby generating toner dusts in machine.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An encapsulated toner for heat-and-pressure fixing comprising a heat-fusible core material containing at least a thermoplastic resin and a coloring agent and a shell formed thereon so as to cover the surface of the heat-fusible core material, a main component of the shell being a hybrid resin comprising a molecular chain obtainable by condensation polymerization selected from the group consisting of polyesters, polyester-polyamides and polyamides; and a molecular chain obtainable by addition polymerization which is selected from vinyl resins obtained by radical polymerization; the two types of the molecular chains being chemically bonded together.

2. The encapsulated toner for heat-and-pressure fixing according to claim 1, wherein said hybrid resin has a glass transition temperature of from 50° to 80° C.

3. The encapsulated toner for heat-and-pressure fixing according to claim 1, wherein said hybrid resin has an acid value of from 3 to 50 KOH mg/g.

4. The encapsulated toner for heat-and-pressure fixing according to claim 1, wherein said hybrid resin is obtainable by concurrently carrying out condensation polymerization reaction and addition polymerization reaction in one reaction vessel by using a mixture containing monomers for a condensation polymerization resin, monomers for an addition polymerization resin, and a compound capable of reacting with both monomers for a condensation polymerization resin and monomers for an addition polymerization resin.

5. The encapsulated toner for heat-and-pressure fixing according to claim 4, wherein the weight ratio of the monomers for the condensation polymerization resin to the monomers for the addition polymerization resin is in the range of from 50/50 to 95/5.

6. The encapsulated toner for heat-and-pressure fixing according to claim 1, wherein the glass transition temperature ascribed to said thermoplastic resin used as a main component of the heat-fusible core material is from 10° to 50° C.

7. A method for producing an encapsulated toner for heat-and-pressure fixing comprising a heat-fusible core material containing at least a thermoplastic resin and a coloring agent and a shell formed thereon so as to cover the surface of the heat-fusible core material, comprising the step of carrying out in situ polymerization using a hybrid resin comprising a molecular chain obtainable by condensation polymerization selected from the group consisting of polyesters, polyester-polyamides and polyamides; and a molecular chain obtainable by addition polymerization which is selected from vinyl resins obtained by radical polymerization; the two types of the molecular chains being chemically bonded together, while localizing the hybrid resin as an outermost layer of toner particles, to thereby form a shell with the hybrid resin on the surface of the heat-fusible core material.

8. The method according to claim 7, wherein the amount of said hybrid resin is from 3 to 50 parts by weight, based on 100 parts by weight of the heat-fusible core material.

9. The method according to claim 7, wherein said hybrid resin has an acid value of from 3 to 50 KOH mg/g.

10. The method according to claim 7, wherein said hybrid resin is obtainable by concurrently carrying out a condensation polymerization reaction and an addition polymerization reaction in one reaction vessel by using a mixture containing monomers for making a condensation polymerization resin selected from the group consisting of polyesters, polyester-polyamides and polyamides; monomers for making an addition polymerization resin selected from vinyl resins obtained by radical polymerization; and a compound capable of reacting with both of said monomers for said condensation polymerization resin and said monomers for said addition polymerization resin.

11. The method according to claim 10, wherein the weight ratio of said monomers for said condensation polymerization resin to said monomers for said addition polymerization resin is in the range of from 50/50 to 95/5.

* * * * *